US005186320A

United States Patent [19]

Aida

[11] Patent Number: 5,186,320

[45] Date of Patent: Feb. 16, 1993

[54] RETAINER FOR RETAINING ARTICLES ACCOMODATED IN A CASE

[75] Inventor: Masaaki Aida, Tokyo, Japan

[73] Assignee: Midori Co., Ltd., Tokyo, Japan

[21] Appl. No.: 707,807

[22] Filed: May 30, 1991

[51] Int. Cl.[5] ..... B65D 5/50; A45C 11/34

[52] U.S. Cl. ..... 206/45.19; 206/214

[58] Field of Search ..... 206/45.14, 45.15, 45.16, 206/45.17, 45.18, 45.19, 214, 477–483

[56] References Cited

U.S. PATENT DOCUMENTS

| | | | |
|---|---|---|---|
| D. 188,819 | 9/1960 | Parker et al. | 206/45.19 X |
| 328,412 | 10/1885 | Kron | 206/45.19 |
| 3,182,790 | 5/1965 | Biegahousky et al. | 206/45.19 |
| 3,533,503 | 10/1970 | Wood et al. | 206/45.19 |
| 3,880,283 | 4/1975 | Flaherty et al. | 206/45.19 X |
| 4,595,097 | 6/1986 | Herstein | 206/45.14 X |

FOREIGN PATENT DOCUMENTS

| | | | |
|---|---|---|---|
| 654504 | 12/1962 | Canada | 206/45.19 |
| 205392 | 12/1986 | European Pat. Off. | 206/477 |
| 2821958 | 11/1978 | Fed. Rep. of Germany | 206/45.19 |
| 1474036 | 2/1967 | France | 206/45.19 |

*Primary Examiner*—William I. Price

*Attorney, Agent, or Firm*—Wenderoth, Lind & Ponack

[57] ABSTRACT

An accommodated article retainer retains various articles such as writing tools and cosmetics in a sandwiched state in various cases. The retainer comprises a base, which can be removably set in a case body. One or more pawl pairs, each having two opposed pawls, project upright from the top of the base. The opposed pawls in each pair have their upper ends provided with respective horizontal outward extensions, which are inserted upwardly through openings of an intermediate case member such that, after their insertion, the intermediate case member is entirely retained on the base by the extensions.

10 Claims, 4 Drawing Sheets

RETAINER FOR RETAINING ARTICLES ACCOMODATED IN A CASE

BACKGROUND OF THE INVENTION (1) Field of the Invention

The invention relates to cases for accommodating various articles such as writing tools and cosmetics, and, more particularly, to an accommodated article retainer used with such cases for retaining the accommodated articles in a sandwiched state.

(2) Description of the Prior Art

Heretofore, there have been known various means for retaining such things as writing tools and cosmetics accommodated in cases. However, these well-known retaining means are either complicated in construction and lead to a high cost, or, if their construction is simple, can not withstand long use.

In other words, there has hitherto been no accommodated article retainer, which is simple in construction, leading to low cost, and nevertheless can withstand long use.

SUMMARY OF THE INVENTION

The invention has been developed in light of the above circumstances, and has an object of providing an accommodated article retainer which is simple in construction, leading to low cost, can withstand long use and can be broadly used with various cases for accommodating various articles.

According to the invention, an accommodated article retainer for retaining various articles such as writing tools and cosmetics in a sandwiched state in cases comprises a base capable of being removably set in a case body and one or more pawl pairs, each pawl pair consisting of two opposed pawls projecting upright from the top of the base.

The base and one or more pawl pairs may be formed together as a one-piece molding of rubber or like elastic material.

According to the invention, there is further provided an accommodated article retainer in which the upper ends of opposed pawls in each pair are provided with respective horizontal outward extensions, and which further comprises an intermediate case member having openings through which the horizontal outward extensions are inserted upwardly such that after insertion thereof the intermediate case member is entirely retained on the base by the horizontal outward extensions.

With the above construction of the accommodated thing retainer according to the invention, after setting the base in the case body an article (for instance a writing tool) can be conveniently retained in a sandwiched state between opposed pawls projecting upright form the top of the base.

With the base and one or more pairs of opposed pawls formed together as a one-piece molding of rubber or like material, the function of retaining an article in a sandwiched state is reinforced.

With the structure of the accommodated article retainer, in which the upper ends of opposed pawls in each pair are provided with respective horizontal outward extensions, and which further comprises an intermediate case member having openings through which the horizontal outward extensions are inserted upwardly such that after insertion thereof the intermediate case member is entirely retained on the base by the horizontal extensions, an article can be accommodated and retained with a good appearance in the case body.

The above and other objects, features and advantages of the invention will become more apparent from the following description of a preferred embodiment taken with reference to the accompanying drawings.

DETAILED DESCRIPTION OF THE PREFERRED EMBODIMENTS

Figure 1:
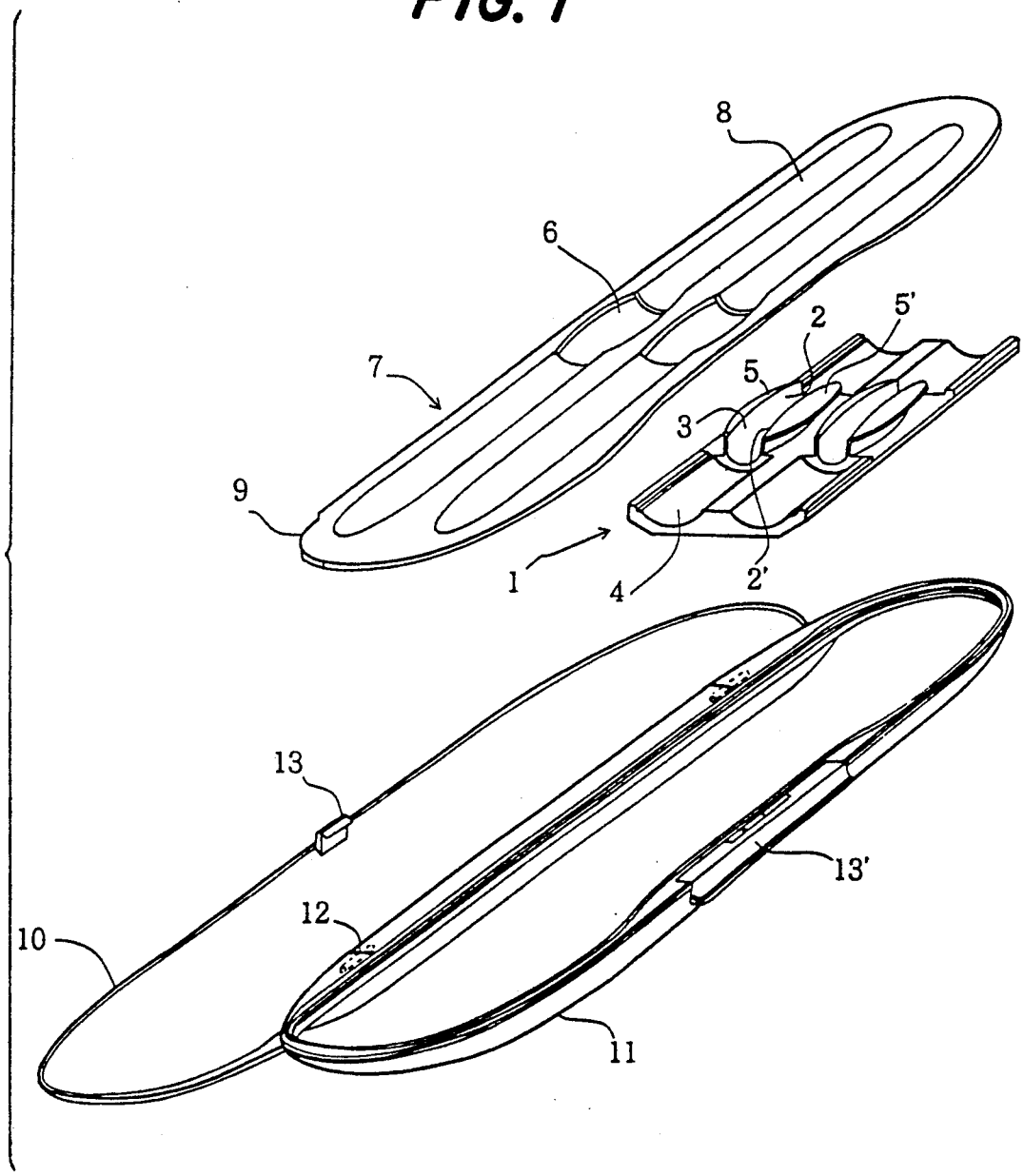
FIG. 1 is an exploded perspective view showing an embodiment of an accommodated article retainer according to the invention.
Figure 2:
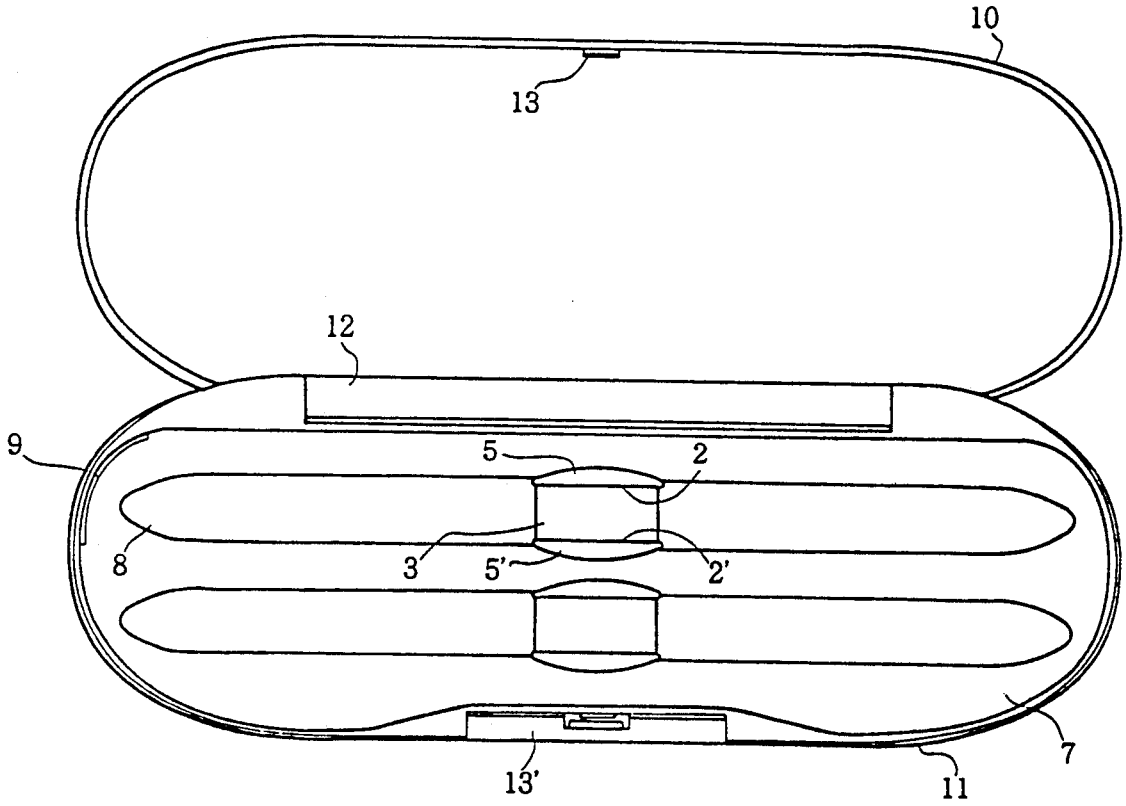
FIG. 2 is a plan view showing the accommodated article retainer of FIG. 1 set in a case body.
Figure 3:
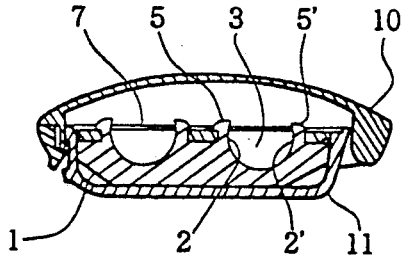
FIG. 3 is a longitudinal central sectional view showing the accommodated article retainer of FIGS. 1 and 2.
Figure 4:
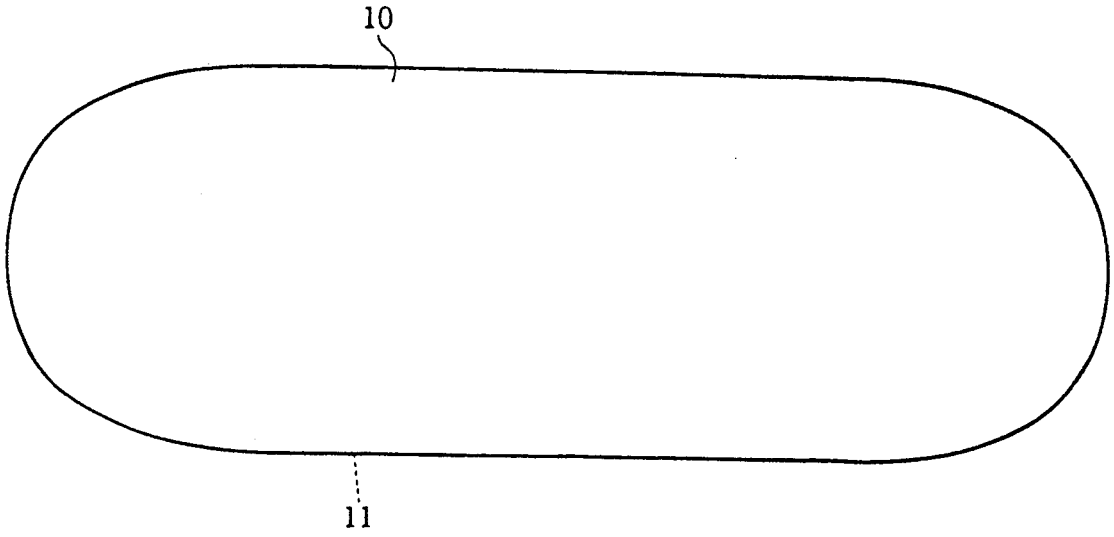
FIG. 4 is a plan view showing a case closed by a lid member and accommodating the embodiment of the accommodated article retainer of FIGS. 1–3.
Figure 5:
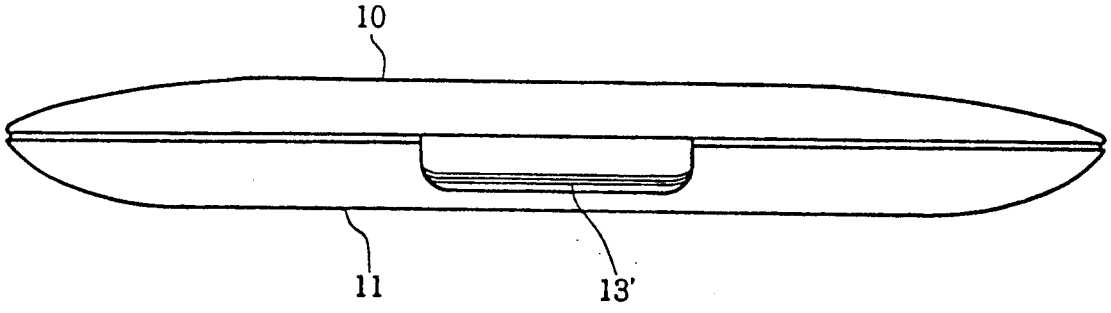
FIG. 5 is a front elevational view showing the case of FIG. 4.
Figure 6:
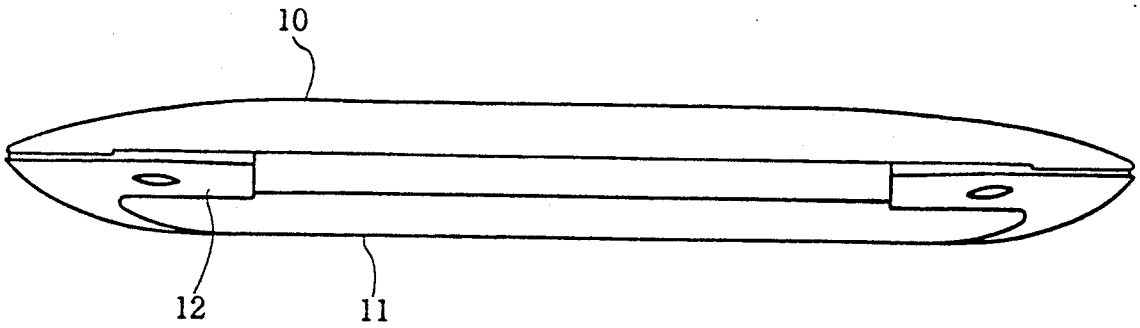
FIG. 6 is a back elevational view showing the case of FIG. 4.
Figure 7:
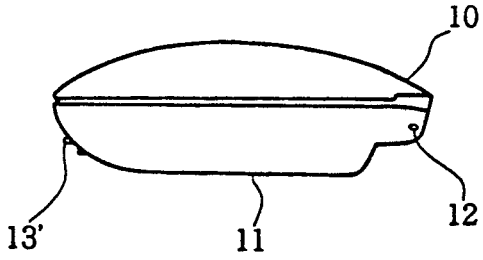
FIG. 7 is a right side view showing the case of FIG. 4.

Embodiments of the invention will now be described with reference to the accompanying drawings.

The invention concerns an accommodated thing retainer for retaining, in a sandwiched state, such things as writing tools and cosmetics accommodated in various cases. The following embodiments of the invention will be described in conjunction with a case for accommodating writing tools.

Referring to the Figures, a first embodiment of the accommodated article retainer according to the invention comprises a base 1 and one or more pawl or tab pairs. Each pawl pair has two opposed pawls 2 and 2' projecting upright from the top of base 1. Base 1 is accommodated in a case body 11 for accommodating writing tools (not shown) and provided with hinged lid member 10 for opening and closing the case.

In this embodiment, base 1 has a flat bottom, and its top is formed with curved recesses 4 extending along grooved portions 3 defined by each pair of opposed pawls 2 and 2'. Base 1 and the pairs of opposed pawls 2 and 2' are formed as a one-piece molding of rubber or like elastic material.

In a second embodiment of the invention, the upper ends of the opposed pawls 2 and 2' in each pair are provided with respective horizontal outward extensions 5 and 5'. An intermediate case member 7 is also provided. Intermediate case member 7 has openings 6, through which the horizontal outward extensions 5 and 5' are upwardly inserted such that, after insertion thereof, the intermediate case member 7 is entirely retained by the base 1 with the horizontal outward extensions 5 and 5'. Intermediate case member 7 is suitably formed with curved recess portions 8 conforming in profile to curved recesses 4 of base 1. Further, the outer periphery of intermediate case member 7 may be provided at a suitable position with a very narrow finger or tab insertion notch 9 so that the intermediate case member 7, once accommodated in the case body 11 such that it is set in the base 1, may be conveniently removed together with base 1 from the case body 11.

Case body 11 and the lid member 10 are hinged together by hinges 12, as shown. In addition, the lid 10 may be engaged with the base body 11 by engagement projections 13 and 13'.

The above construction of the accommodated thing retainer has the following functions.

In the first embodiment of the invention, after the base 1 is set in the case body 11, an article (for instance a writing tool) can be readily retained in a sandwiched state between opposed paws 2 and 2' projecting upright from the top of base 1. If the base 1 and one or more pairs of the opposed pawls 2 and 2' are formed together as a one-piece molding of rubber or like material, the function of retaining an article in a sandwiched state is reinforced.

In the second embodiment of the invention, the upper ends of the opposed pawls 2 and 2' in each pair are provided with respective horizontal outward extensions 5 and 5'. The intermediate case member 7 is further provided, which has openings 6 for upward insertion therethrough of the horizontal outward extensions 5 and 5' so that the intermediate case number 7 is entirely retained on the base 1 by the horizontal outward extensions 5 and 5'. After assembling the intermediate case member 7 and the base 1 and setting the assembly in the case body 11, an article can be accommodated in a good appearance in the case body.

The above embodiments of the invention are by no means limitative, and various changes and modifications to them are possible without departing from the scope and spirit of the invention. For example, the shape of opposed pawls 2 and 2' on base 1 may be suitably selected to suit the shape of a thing to be accommodated such that the thing can be readily retained in a state sandwiched between the opposed pawls or tabs. Likewise, the shapes of the recesses 4 of the base 1, and the recessed portions 8 and the openings of the intermediate case member 7 may be suitably selected to suit the selection of the shape of the opposed pawls.

As has been described in the foregoing, the accommodated article retainer according to the invention, which comprises the base or the base and the intermediate case member assembled therewith, and having a simple structure, can be provided at low cost. In addition, since it has no component part or portion having a structure liable to be damaged during use, it can withstand long use. In addition to the above advantages, it can be extensively used with various cases for accommodating various articles.

What is claimed is:

1. A retainer for retaining articles to be accommodated in a case, comprising:

a substantially flat, elongated base;

at least one pair of tabs for sandwiching an article therebetween extending upwardly from said base;

a grooved portion extending between said pair of tabs in the direction of elongation of said base;

a recess in said base adjoining said grooved portion in the direction of elongation;

an extension on the upper end of each said tab extending horizontally away from said grooved portion; and an intermediate case member having an opening therein engaged by said extension of said tabs such that said intermediate case member is held on said base.

2. The retainer of claim 1, wherein said tabs extend along said grooved portion and are made of an elastic material.

3. The retainer of claim 1, wherein said base and said tabs are a one-piece molding of an elastic material.

4. The retainer of claim 1, wherein said recess extends from each of the opposite ends of said grooved portion.

5. The retainer of claim 1, wherein said retainer is loosely disposed in a case for holding an article in said case.

6. The retainer of claim 1, wherein said base has two said pairs of tabs thereon.

7. A retainer for retaining articles to be accommodated in a case, comprising:

a base;

at least one pair of tabs for sandwiching an article therebetween extending upwardly from said base;

a horizontal extension on each said tab extending outwardly from said tab; and an intermediate case member having at least one opening therethrough, said horizontal extension of said pair of tabs extending through said opening to retain said intermediate case member on said base.

8. The retainer of claim 7, wherein said base is flat and elongated, a grooved portion extends between said tabs in the direction of elongation of said base and a recess adjoins said grooved portion in an area on said base outside of said tabs in the direction of elongation of said base.

9. The retainer of claim 8, wherein said intermediate case member has at least one recess portion therein adjoining said opening in the direction of elongation of said base.

10. The retainer of claim 7, wherein said base and said tabs are a one-piece molding of an elastic material.

* * * * *